United States Patent [19]

Catan

[11] 4,450,755

[45] May 29, 1984

[54] AIR BLOWER ARRANGEMENT FOR PRODUCING AIR SCREEN AND RELATED METHOD

[75] Inventor: Robert S. Catan, Smithtown, N.Y.

[73] Assignee: Dynaforce Corporation, Old Bethpage, N.Y.

[21] Appl. No.: 345,576

[22] Filed: Feb. 4, 1982

[51] Int. Cl.[3] ..... F24F 9/00

[52] U.S. Cl. ..... 98/36; 415/204; 415/206

[58] Field of Search ..... 98/36, 40 N; 415/203, 415/204, 206, 219 B, 219 C; 417/350

[56] References Cited

U.S. PATENT DOCUMENTS

| | | | |
|---|---|---|---|
| 2,452,274 | 10/1948 | Walters | 415/204 X |
| 3,191,851 | 6/1965 | Wood | 415/204 X |
| 3,221,983 | 12/1965 | Trickler et al. | 415/206 X |
| 3,396,651 | 8/1968 | Kamiya et al. | 98/36 X |
| 3,874,191 | 4/1975 | Hudson | 415/206 X |

*Primary Examiner*—Albert J. Makay
*Assistant Examiner*—Harold Joyce
*Attorney, Agent, or Firm*—Posnack, Roberts, Cohen & Spiecens

[57] ABSTRACT

A blower apparatus is provided especially suitable for an air curtain, screen or barrier. The apparatus includes a blower in the form of a plurality of blades arranged to describe a cylinder. A guide encircles the blower, but is open-ended thereupon and extends axially beyond the blower to generate an air stream, the width of which is greater than that of the blower. A deflector or interceptor plate is arranged, which is coextensive with that portion of the guide, which extends beyond the blower and which is coextensive with a portion of the blower in a range of about 45°-90° thereof. The deflector or interceptor plate prevents air from circulating in an axial direction back into the blower and therefore improves the effectiveness of generation of the air stream, which flows tangentially out of the blower arrangement.

23 Claims, 4 Drawing Figures

AIR BLOWER ARRANGEMENT FOR PRODUCING AIR SCREEN AND RELATED METHOD

FIELD OF INVENTION

This invention relates to air blowing apparatus and methods and more particularly to apparatus and methods for producing air screens, barriers and/or curtains.

BACKGROUND

There are many advantages inherent in the generation and utilization of air barriers, screens and/or curtains. For example, with the use of the same, it is possible to eliminate mechanical barriers and to prevent the penetration of objects and temperature differentials while eliminating mechanical constructions and providing ready access through doorways and other such openings. It is also known to provide air blowing arrangements and techniques in accordance with which a curtain, screen or barrier is generated, the width of which is generally in direct correspondence with the blowing arrangement, which generates the air flow resulting in the curtain, screen or barrier.

There has been some experimentation in the generation of curtains, screens and/or barriers, whereby the width of the resulting curtain, screen or barrier greatly exceeds that of the air blowing mechanism which is utilized. This enables the utilization of air blowing apparatus in a generally economic way with the exception that there is a loss in air flow force which renders the impermeability to penetrating objects and temperature differential less effective.

The utilization of air blowing apparatus capable of forming curtains, screens and barriers is shown in a number of U.S. Patents, as, for example, U.S. Pat. Nos. 3,112,686; 3,215,058; 3,256,798; and 3,394,755.

In U.S. Pat. No. 3,112,686 H. R. Perterson discloses an air screen producing mechanism. Therein is disclosed an apparatus for producing a variable thickness air screen, which includes a panel member having a downwardly extended end wall at each end thereof, with the panel member having at least one opening therein. An air blower is mounted on the panel member and communicates with the opening to deliver air therethrough. In accordance with the invention, there is provided a pair of elongated spaced-apart louver members spanning the end walls and rockably supported thereby. The end walls form a closure for the ends of the louver members. The panel member and end walls form a header having an opening through which air may be discharged and an arrangement is connected with each of the louver members for rocking the same relatively to one another for varying the size of the bottom opening. An arrangement is provided on each of the end walls for securing the louvers in adjusted position. In this arrangement an air curtain is generated, with width of which is larger than the associated air blowing mechanisms, but as will be seen, this apparatus does not employ air blowers with open scrolls, nor means for maintaining the effectiveness of the resulting air screen in the manner and with the efficiency of the apparatus and methods of the present invention.

G. Anderson in U.S. Pat. No. 3,215,058 reveals an air curtain apparatus in which air blowers are employed to generate air curtains and in which air blowers are mounted on opposite sides of a motor to generate an air curtain, which has effectively the width of the combined blowers and motor. There is no arrangement whereby the air curtain spreads effectively beyond the width of the associated blowers and, in this respect, the Anderson apparatus differs from that of the present invention. Specifically, it is an object of the Anderson invention to provide an air curtain producing apparatus, which includes a housing structure mountable adjacent the top of a doorway and having a mechanism associated therewith for producing a stream of air and directing the same downwardly through an orifice in the housing structure. The stream of air passes between depending partitions hingeably mounted in a predetermined spaced-apart relation on opposite sides of the housing orifice to cause the air flowing therebetween to form an air curtain within the doorway. An arrangement is provided for swinging the partitions in unison while maintaining the predetermined spacing therebetween, whereby the median plane of the air curtain may be deflected on both sides of the vertical to form acute angles thereby permitting the most effective application of the air curtain with regard to ambient air conditions on either side of the curtain to be obtained, so that the air curtain is readily applicable for use as thermal and decontamination barriers. Moreover, the partitions present inner opposed surfaces, one of which is planar and the other of which is convex, so that a venturi effect is produced on the air flowing between the partitions, whereby the air flow of at least one of the faces of the air curtain is of non-turbulent nature and wherein little diffusion occurs between ambient air and the air curtain, so that the air curtain functions as an effective barrier. As will be shown, the arrangement in this patent does not provide for laterally increasing the spread of the air curtain beyond the blowers, nor does it make provisions to prevent a thusly spread air curtain from losing effectiveness.

In U.S. Pat. No. 3,256,798 H. M. Melzer discloses an apparatus for generating a flow of air which is directed across a doorway or other access opening to form a barrier to the passage of heat and for resisting penetration by foreign objects. Therein is disclosed a casing having an internal volute-shaped chamber terminating in a narrow slot forming an outlet from the chamber with a plurality of spaced directing vanes disposed in the slot, angularly movable therein to shape the flow of air as it passes through the slot. A pair of spaced pumping elements is located in the chamber with mounting means for the same, which extend through the chmber in the form of relatively thin members having plate-like configuration extending across the chamber and disposed edgewise to the flow of air within the casing. A mounting is provided which serves to mount the pair of spaced pumping elements within the chamber and this is secured to the casing through a wall thereof and suspend the device in its operative position with a motor being provided for the pumping elements and inlets being provided at each end of the casing to provide an inflow of air to the interior of the casing, the inlets being formed of a plurality of annular concentric inlet passages. An angularly movable baffle is provided for controlling the effective cross section of the concentric passages. The apparatus disclosed in this patent differs from that of the present invention for the reason indicated above and as will be pointed out in greater detail hereinafter.

J. Morrison in U.S. Pat. No. 3,394,755 reveals an air screen creating an air conditioning apparatus which draws in air at ambient temperature and, when mounted adjacent openings, creates an air screen, the velocity of which is determined by a number of factors. If the velocity of the air forming the screen is too great, in-spill from the air screen at floor level results and causes air at ambient temperature to flow into the associated room. This has the effect of raising or lowering the temperature of the room dependent upon whether the temperature of the ambient air is higher or lower than that in the room. It is therefore necessary to reduce in-spill at floor level and this may limit the velocity of the air screen to an extent that the screen is not effective in resisting external influences. According to J. Morrison, an air screen creating air conditioning apparatus is devised to produce two separate streams of air, one stream being at ambient temperature, and the other stream being at heated or cooled temperature at or near the outlet with a valve arrangement being incorporated in advance of heating or cooling apparatus to regulate the volume of air forming each such stream. Thus there is provided a casing having first and second sections, one of which has an inwardly converging arrangement of walls forming an outlet with a deflector plate arrangement being mounted in one of the sections for preventing recirculation of air into the other section and for minimizing turbulence in the flow of air through the casing. Fan wheels are mounted in the other section for creating the flow of air and air deflector arrangements are mounted in the other section in the path of the flow of air for spreading the flow throughout the length of the casing. A division wall arrangement is mounted in the outlet for dividing the flow of air into two separate streams. An inlet arrangement is provided in the casing for introducing ambient air to the fan wheel whereby the flow of air is created at ambient temperature with the division wall arrangement directing the other stream over the heating or cooling arrangement. An air deflector arrangement is positioned across the outlet in alignment with the division wall arrangement. This construction differs from that of the present invention for reasons which will appear in greater detail hereinbelow.

SUMMARY OF INVENTION

Given the present state of the prior art inclusive of arrangements of the above-noted type, it is an object of the invention to provide improved apparatus and methods for the generation and utilization of air screens, barriers and/or curtains and, more particularly, to provide improved arrangements and methods whereby a wider effectiveness is provided for curtains, screens and barriers while utilizing air generating apparatus of a width substantially less than the resulting barriers, screens and/or curtains.

It is a further object of the invention to provide for utilizing air blowers devoid of side plates while maintaining the efficiency and effectiveness thereof and while nevertheless maintaining the wide coverage resulting from the removal of such side plates.

It is still another object of the invention to utilize open scroll designs while enhancing the efficiency which would be otherwise lost by going to open scroll designs, which are utilized in such a manner as to avoid the additional ducting which would otherwise be required to get the enhanced width which is achieved.

In achieving the above and other objects of the invention, there is provided an apparatus which includes a first arrangement for receiving an input of air in generally axial direction and generating a rotary flow of this air from the input and discharging the air in generally tangential direction, but with an axial spread in at least one direction and a second arrangement being provided to intercept the axial spread in part to prevent return of the air therein to the rotary flow, whereby to minimize pressure dissipation in the thusly discharged air. The first arrangement noted above, may, in accordance with the invention, include a blower of generally cylindrical configuration with the second arrangement including an interceptor plate axially displaced relative to the blower and located in a plane at least substantially tangent to the blower. The first arrangement, in accordance with the invention, will include an open-ended scroll, at least partly encircling the blower and extending axially beyond the same to guide the above-mentioned axial spread.

In accordance with one aspect of the invention, the aforesaid interceptor plate may be of curved configuration, the blower and plate having respective radii with the radius of the blower being smaller than the radius of the plate. The plate may, however, be of other forms, but is preferably such that it is formed of generatrices which are substantially parallel to the axis of the blower. Moreover, the plate will generally coincide to no more than about 90° of the cylindrical extent of the blower, as will be illustrated in further detail hereinbelow.

In further accordance with the invention and in addition to the scroll, there is provided a cover partly enclosing the blower and plate and provided with intake and discharge openings for the flow of air. The cover includes at least one end axially spaced from the blower with the above-noted interceptor plate occupying at least 50 to about 100% of the spacing between this end and the blower. In conventional form the blower will preferably include a plurality of curved plates arranged in parallel on an imaginary cylinder, there being a motor or drive shaft connected to and rotating the blower on the axis thereof. The spacing noted above, between the end of the cover and the blower, will preferably be at least as large as the radius of the blower.

In accordance with a further embodiment or definition of the invention, a second blower and interceptor plate will be provided in mirror relationship to the first mentioned blower and interceptor plate and there will be provided a motor, which is arranged between and is coupled to both said blowers for driving the same. Moreover, the intake and discharge openings will preferably be perpendicularly related to one another. In accordance with the invention, there may be provided a further interceptor plate in positional correspondence with the motor while the scroll will preferably include a first part extending substantially the entire width of the aforementioned cover with tongues being provided thereon curling partly around the blowers. In this arrangement of the invention, the first part mentioned hereinabove will be at least substantially parallel to a tangent to the cylindrical configuration and the tongues will include end portions curved toward the blowers to define peripheral cut-off zones on the blowers with the interceptor plates extending from the cut-off zones by an amount corresponding to about 45°–90° of the associated blowers, as will be shown in greater detail hereinbelow. In a preferred arrangement, the interceptor plates may be axially spaced from the associated blowers by at least about one-half of an inch or in this order of magnitude of spacing.

According to the methods of the invention, provision is made for rotationally impelling air along a determinable generally circular path while taking the air into the path from at least one axial direction and discharging the air tangentially to the path with an axial spread to form at least part of an air curtain, barrier or screen having a width exceeding the breadth of the path and blocking the air, which is being tangentially discharged and which is in the axial spread, from returning into the circular path, thereby to optimize the pressure of air in the curtain. The air is blocked with a sheet, as noted generally above, in the form of a plane having generatrices which are parallel to the axis of the circular path. Moreover, the circular path is substantially enclosed and air input is arranged in at least substantially perpendicular relationship to the tangential discharge of the air. Still further, the aforementioned sheet is arranged to strip the air from the circular path and to guide the air, at least in part, along the tangential path.

The above and other objects, features and advantages of the invention will be found in the detailed description, which follows hereinbelow as accompanied by the associated drawing.

DETAILED DESCRIPTION

H. Peterson, G. Anderson and J. Morrison show respectively in FIG. 5 of U.S. Pat. No. 3,112,686, FIG. 2 of U.S. Pat. No. 3,251,058 and FIG. 2 of U.S. Pat. No. 3,394,755 closed-end scroll arrangements which defeat the purpose of the present invention and require that the spreading of resulting air screens, curtains or barriers be generated subsequent to the original stream flow in a manner inconsistent with and far less effective than the arrangements and methods of the present invention, as will be shown in greater detail hereinbelow. More particularly, there will be shown hereinbelow an open-ended scroll arrangement which allows the lateral spread of air flow, with this improvement being utilized in conjunction with one or more interceptor plates axially displaced from the associated air blower or air blowers in such a manner as to retain the efficiency and effectiveness of the air stream flow, while nevertheless permitting the obtaining of the advantage of an air curtain, screen or barrier with a wider than expected width being generated therefor.

Figure 1:
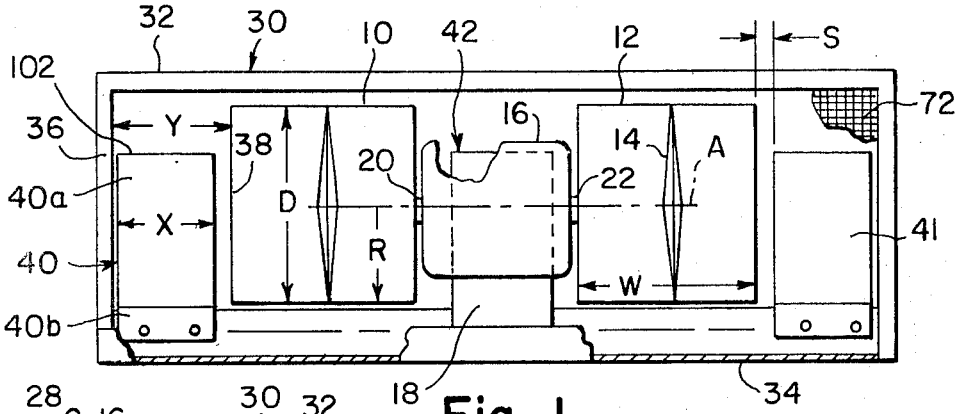
FIG. 1 diagramatically illustrates a longitudinal arrangement of air blowers and interceptor plates in accordance with the invention in a casing or part of a casing and provided with a driving motor.

In FIG. 1 appears a pair of air blowers 10 and 12 generally of the form illustrated in the Melzer U.S. Pat. No. 3,256,798 and being of generally cylindrical shape and rotatable about an axis such as indicated at A. Such blowers may be formed of two parts in side-to-side relationship and having and being connected by disks indicated generally at 14, which are connected through a shaft to an associated electric motor, such as indicated diagrammatically at 16. The disks 14 may be solid or perforated and the cylindrical configuration of the air blower is open-ended so that air may be drawn in in axial direction through the same and impelled along a circular path generated in generally cylindrical configuration by a plurality or multitude of curved slat-like blades, which lie generally parallel to the axis A and are in parallel relationship with one another. In some embodiments of the invention, these curved blades may be slightly inclined relative to the axis A to generate a slightly varied form of air discharge. The blowers or the cylinder described thereby, are illustrated as having a diameter indicated at D or a radius indicated at R. The motor 16 is mounted on a base 18 and shafts extend from the opposite ends of the motor 16, such as indicated at 20 and 22, the respective blowers being concentric with and mounted on the shafts 20 and 22.

Figure 2:
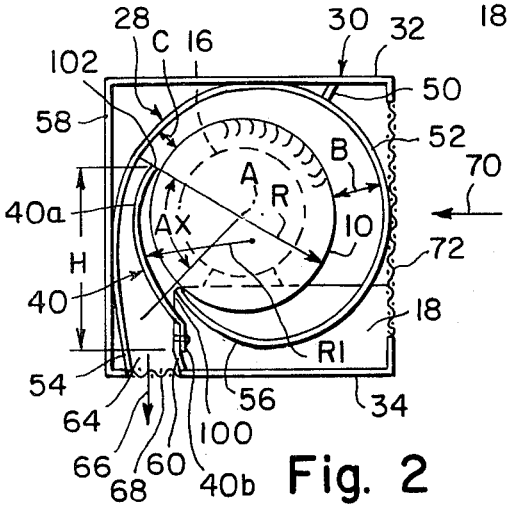
FIG. 2 diagramatically illustrates the arrangement of one of the blowers of FIG. 1 together with an open-ended scroll, this view illustrating the scroll within the casing and the positional relationship of the associated interceptor plate.

The open-ended scroll is shown in diagrammatic and end view in FIG. 2 and 28. The detailed configuration of this scroll will be discussed in greater detail hereinafter. In FIG. 2, as well as in FIG. 1, it is furthermore shown that the open-ended scroll is contained within a housing or casing 30 having an upper portion 32, a lower portion 34 and at least one end portion 36. The end portion 36 is utilized by way of illustration and shows that the lateral extremity 38 of the blower is spaced from the end portion 36 of the casing 30 by a distance Y, which allows the spreading of the air curtain and the generation of an air curtain, which substantially exceeds the width of the related air blower. It is preferred that the distance Y preferably be at least as great as the radius R of the air blower to generate an air curtain having an effective width, which is substantially greater than the width of the associated air blower, which is indicated by way of example at W.

In accordance with the invention in the illustrated form of FIG. 1, there are furthermore provided two interceptor plates 40 and 41 positioned on the outer lateral extremities of the respective air blowers 10 and 12. A third interceptor plate 42 is provided in positional correspondence with the motor 16 and is located intermediate the positional projection of the blowers 10 and 12. As is generally indicated the interceptor plates 40 and 41 may be axially spaced from the associated air blower by a distance illustrated at S, which distance may be, for example, a minimum of an order of magnitude of about one-half of an inch. Generally a closer physical relationship is preferred, but it is likewise preferred that no structural interference occur between the blowers and interceptor plates which are positioned in entirety to the side of the blowers without extending across the same, as is the case in other arrangements of supports and plates provided in accordance with other and superseded inventions.

The interceptor plates 40 and 41 have a physical width indicated generally at X. This physical width X is preferably closely related to the distance Y between the end of the associated blower and the end 36 of the casing or to the corresponding dimension relating to the axial spread of the associated curtain, screen or barrier. Thus, the interceptor plate will preferably cover as much of this spread as possible, although, for example, the covering of a range between about 50 and 100% of the spacing Y will be acceptable according to the degree of effectiveness which is desired. This occupation by the interceptor plate of a given amount of the associated spacing will also apply to the centrally located interceptor plate 42, lying between the air blowers, as well.

The scroll 28 is illustrated in FIG. 2 as being generally of monolithic construction. However, it may consist of two or three or more connected parts bolted together and forming a physical barrier. It will be formed of several parts to permit ease in assembly and mounting. It will be noted, for example, that one such mounting appears diagrammatically at 50. The scroll will include portions having a volute configuration with a variable spacing from the blower 10 or 12, such as indicated by way of example at B and C, the spacing B being greater than the spacing C in a diametrical sense. The open-ended scroll 28 has, for example, a circular portion 52, a portion 54 and a portion 56. The portion 54 runs generally parallel to the rear wall 58 of the casing 30 and is as well generally parallel to, or substantially parallel to, a tangent to the cylinder defined by the air blower 10, the axis of which is indicated at A. Portion 54 will define with flange 60 on the bottom 34 of casing 30, a throat or discharge opening 64 through which air will flow vertically downward in the form of a screen, as indicated by arrow 66. A screen 68 is indicated by means of which ingress is prevented by solid objects, such as insects and the like, this screen being particularly effective when the flow of air is cut-off, such as by cessation of operation of the motor 16. An air intake opening is indicated at 70 by an appropriate arrow, there being provided a screen 72 to shield the associated inlet opening from the ingress of insects and other foreign objects during operation of the apparatus.

Figure 3:
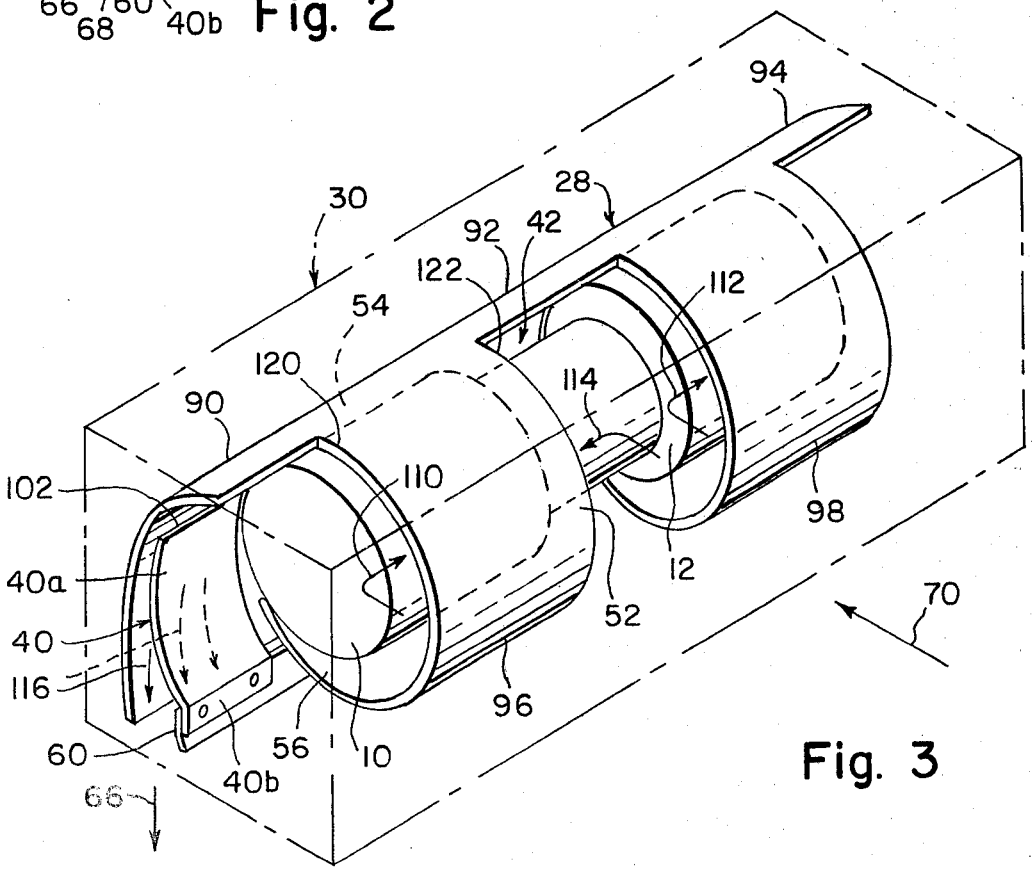
FIG. 3 is a diagrammatic perspective view illustrating the positional relationship of the open-ended scroll and tongues extending therefrom in positional relationship with the associated blowers, this view further showing the direction of air flow resulting in accordance with the invention.

It will be understood from what has been stated above that the generation of air flow around a circular path is effected by rotation of each blower upon its associated axis, as caused by operation of the motor 16 through shafts 20 and 22. It will be further understood that this air flows through the circular path, at least in part through the spacing indicated at B and C and then flows through the outlet opening, as indicated by arrow 66. The generation of a conventional air curtain, barrier or screen, by the technique indicated, is too well known to warrant discussion in this text. Referring next to FIG. 3, it will be seen that the scroll 28 consists of a first part, which extends substantially the entire longitudinal extent of the housing 30. It thus includes a portion 90 which extends laterally or axially beyond the associated blower 10. It furthermore includes a section 92 which extends between the blowers 10 and 12 and it includes a further portion 94, which extends axially or laterally beyond the blower 12. In addition, it includes tongues 96 and 98 including the aforementioned portions 52 and 56 (see also FIG. 2). The portion 54 generally has width and a positional correspondence related to the associated air blower. It circles around and generally encloses the associated air blower forming a circular air path therewith. While the spacing of portion 52 varies in respect of the periphery of the associated air blower, as discussed above relative to dimensions B and C, the portion 56 curls inwardly toward the periphery of the associated air blower and forms a cut-off zone generally indicated at 100 (see FIG. 2). The portion 56 naturally does not go into a position of interference with movement of the associated air blower, but closely approaches the periphery and therefore provides a cut-off zone relative to which circulating air may not penetrate from the course of the circulating air in to the periphery of the wheel, but is definitely deflected therefrom in the spacing corresponding to the actual width of the air blower. This air is then forced to take a direction indicated by arrow 66 and moves tangentially relative to the wheel and into and forming a part of the associated air curtain, screen or barrier.

The interceptor plates, which form a relatively important feature of the invention, are generally related to the aforesaid cut-off point 100 defined by the portion 56. There is illustrated by way of example in FIG. 2 the positional relationship and preferred construction of the interceptor plate 40, as next described below in greater detail.

As seen most clearly in FIG. 2, the interceptor plates typified by the plate 40 have a height generally indicated at H and have a positional correspondence to the cut-off point 100 as indicated above. Thus, the effective portion **40*a* of the plate 40 is mounted by a flange 40*b* connected thereto, this connection taking place with respect to the flange 60 forming a part of the casing 30. Also it will be significantly noted that the examplary plate 40 covers an angular section of the periphery of the cylinder defined by the associated motor and indicated generally at angle AX. This angle corresponds to 45° to 90° of the periphery of the cylinder defined by the associated motor and thereby enables an interception of the lateral spread of the air curtain for obtaining the principal purposes of the invention. More particularly, the leading edge or point 102 of the related interceptor plate approaches closely to, but does not come within a position of interference with the periphery of the associated air blower, and operates in a sense and in projection to peel the air flow from the periphery of the associated air blower in the axially spread portion of the air curtain. Thus, the interceptor plate being to a great extent parallel with and in juxtaposition to the portion 54** of the associated scroll and being coextensive therewith beyond the lateral reaches of the associated blower defines a tangential discharge path for the air lying within the axial spread and prevents this air from being drawn axially back into the associated air blower thereby to be recirculated in the circular path and thereby to lose effectiveness by reducing the amount of air passing into the air curtain in the axially spread portion of the same. Thereby and conversely the preventing of the return of this air axially into the associated air blower greatly increases the effectiveness of the curtain and surprisingly advantageous results have been achieved in tests run relative to this feature of the invention.

Figure 4:
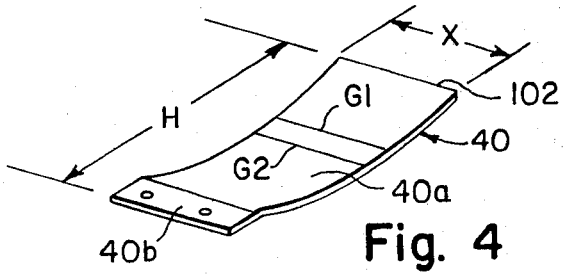
FIG. 4 illustrates in perspective view the shape of an interceptor plate employed in accordance with a preferred embodiment of the invention.

FIG. 4 illustrates in perspective view the general configuration of an air deflector plate such as the deflector plate 40. Therefrom it can be seen that the interceptor plate 40 consists of curved portion **40*a*, edge portion 102, as mentioned hereinabove, and flange portion 40*b*, as mentioned hereinabove. The overall effective height of the interceptor plate is indicated at H with the truly effective portion being the distance H less the effective height of the flange 40*b*. The width of the interceptor plate is indicated at X, as indicated hereinabove, relative to FIG. 1. It will be noted that the preferred version of the interceptor plate is slightly curved. The interceptor plate may as well be angularly configured or may be perfectly planar in the sense of being flat. The preferred version is, as has been noted, a preferably slightly and gently generated curve, the radius R1 of which (see FIG. 2) is eccentrically related to the radius R of the associated blower and is somewhat greater than the same. It will be noted that the interceptor plates are formed in accordance with a plurality of generatrices, such as indicated by way of example at G1 and G2, which are parallel to the axis A of the associated blower and are thus preferably parallel to the generatrices of the associated portion 54 of the scroll 28. This permits the air to be tangentially discharged, as aforesaid, in a manner least interfering with the effective and efficient discharge of air via the exit 64**, as described hereinabove.

Reference to FIG. 3 will now show that air ingresses in the general direction illustrated by arrows 70 and eggresses generally in the direction shown by arrows 66. The air follows the axial directions of ingress shown by arrows 110, 112 and 114 and has an axial spread indicated by arrows 116. The axial spread is effected between the interceptor plates and the main body of the open-ended scroll, which, as seen by reference to tongues 96 and 98, have plane lateral edges 120 and 122, which are open-ended and offer no resistance to the ingress of air nor to the outflow of the air permitting an axial spread thereof.

Thus, the air blower arrangement of the invention provides for generating a rotary flow of air from the input and discharging the air in generally tangential direction, but with an axial spread in at least one direction with an arrangement being made to intercept the axial spread at least in part to prevent return of the air therein to the rotary flow whereby to minimize pressure dissipation in the discharge air. Furthermore it will be noted that in accordance with an important feature of the invention at least one interceptor plate is axially displaced relative to the blower and does not overlap or otherwise positionally correspond with the same, except for the fact that the interceptor plate or plates is or are located in a plane at least substantially tangent to the associated blower. Furthermore in accordance with the invention, an open-ended scroll is provided at least partly encircling the blower and extending axially beyond the blower to guide the axial spread.

In the illustrated example two blowers are shown with interceptor plates in mirror relationship to one another with a motor therebetween. It should be well appreciated that two or more of such complete aggregate units can be mounted within a housing to afford an air curtain of greater width.

In accordance with the invention there is provided a method which comprises generally impelling air along a determinable generally circular path, while taking said air into said path from at least one axial direction and discharging the air tangentially to the path with an axial spread to form at least part of an air curtain having a width exceeding the breadth of this path and blocking the air, which is being tangentially discharged and which is in the axial spread, from returning into the circular path thereby to optimize the pressure of the air in the curtain. In accordance with further aspects of the invention, the air is blocked in the axial spread with a sheet which constricts the flow in the tangential path and which is in the form of a plane having generatrices which are parallel to the axis of the circular path. In further accordance with the invention, the circular path is substantially enclosed and the air input is arranged in an at least substantially perpendicular relationship to the tangential discharge of the air. Still further, it will be noted that the sheet is arranged to strip the air from the circular path and to guide the air, at least in part, along the tangential path.

In further accordance with the invention, it may be noted that apparatus is provided which in another view compises a blower including a plurality of parallel blades arranged to describe a cylinder, a guide including a first part encircling the blower and at least a major portion spaced therefrom, and a second part extending from the first part and substantially parallel to a tangent to the cylinder. The first part is generally axially coextensive with the cylinder and the second part is generally axially coextensive with said cylinder, but includes at least a portion extending in axial direction beyond the cylinder. A deflector plate is provided, which is coextensive with the aforesaid portion and includes an edge portion which is in projection at least substantially touching relationship with the cylinder. This deflector plate is offset axially relative to the cylinder. The cylinder, as noted hereinabove, defines an axis and the deflector plate has the configuration of a plane having generatrices parallel to the axis of the cylinder, all as has been described hereinabove. It will be further noted that considered projected into a plane extending perpendicular to the axis of the cylinder, the deflector plate extends generally along the aforesaid portion of the second part and in substantially tangential direction relative to the cylinder. The first part, moreover, will be seen as including a terminal end portion, which toes in towards the cylinder without engaging in interfering relationship with the associated blower.

There will now be obvious to those skilled in the art many modifications and variations of the structure and methods set forth hereinabove. These modifications and variations will not depart from the scope of the invention if defined by the following claims.

What is claimed is:

1. Apparatus comprising first means for receiving an input of air in generally axial directions and generating a rotary flow of said air from said input and discharge the air in generally tangential direction, but with an axial spread in at least one direction, and second means to intercept the axial spread, in part, to prevent return of the air therein to the rotary flow whereby to minimize pressure dissipation in the discharged air, said first means including a blower of generally cylindrical configuration and said second means including an interception plate axially displaced relative to said blower and located in a plane at least substantially tangent to said blower, said first means including an open ended scroll at least partly encircling the blower and extending axially beyond the blower, said open ended scroll having a first portion forming an air-cutoff zone with the blower, a second portion encircling the blower and a third portion extending from said second portion substantially parallel to a tangent of the blower to form a discharge outlet for the rotary flow of air conveyed through the scroll by the blower, said interception plate being radially spaced from the periphery of the blower and from the scroll so as to be radially positioned in entirety therebetween in spaced relation from both, said plate being positioned between the periphery of the blower and the third portion of the scroll, substantially parallel to and in juxtaposition with said third portion at said discharge outlet to form and guide the axial spread of air in a tangential path, and wherein the spacing of the interception plate with respect to the third portion of the scroll is relatively small radially to peel off the rotary air flow and convey the same as a curtain of air for tangential discharge.

2. Apparatus as claimed in claim 1, wherein said plate is curved, said blower and plate having respective radii with the radius of the blower being smaller than the radius of the plate.

3. Apparatus as claimed in claim 1, wherein said plane is of generatrices which are substantially parallel to the axis of the blower.

4. Apparatus as claimed in claim 3, wherein the plate coincides to no more than about 90° of the cylindrical extent of the blower.

5. Apparatus as claimed in claim 1 comprising a cover partly enclosing the blower and plate and provided with intake and discharge openings for the flow of air, said cover including an end axially spaced from said blower, said plate occupying about 50–100% of the spacing between said end and said blower.

6. Apparatus as claimed in claim 1, wherein said blower includes a plurality of curved blades arranged in parallel on an imaginary cylinder.

7. Apparatus as claimed in claim 1 including a motor connected to and rotating the blower.

8. Apparatus as claimed in claim 5, wherein the spacing is at least as large as the radius of the blower.

9. Apparatus as claimed in claim 5, wherein said first means includes a second blower and interception plate in mirror relationship to the first said blower and interceptor plate, comprising a motor between and coupled to said blowers for driving the same.

10. Apparatus as claimed in claim 5, wherein the intake and discharge openings are perpendicularly related.

11. Apparatus as claimed in claim 9 comprising a further interception plate in positional correspondence with said motor.

12. Apparatus as claimed in claim 9, wherein said scroll includes a first part extending substantially the entire width of said cover and tongues thereon curling partly around said blowers.

13. Apparatus as claimed in claim 12, wherein said first part is at least substantially parallel to a tangent to said cylindrical configuration.

14. Apparatus as claimed in claim 12, wherein said tongues respectively include said first portions which are curved towards said blowers to define the air cutoff zones as peripheral cutoff zones on the blowers, said interceptor plates extending from said cutoff zones by an amount corresponding to about 45°–90° of the associated blowers.

15. Apparatus as claimed in claim 14, wherein said interceptor plates are axially spaced from the associated blowers by at least about one-half of an inch.

16. Apparatus as claimed in claim 1, wherein said portion of the scroll extending axially of the blower is constituted solely by said third portion, said first and second portions of the scroll being limited to the axial extent of the blower and terminating thereat.

17. A method comprising rotationally impelling air by a blower along a determinable, generally circular path while taking said air into said path from at least one axial direction and discharging the air tangentially of said path with an axial spread to form at least part of an air curtain having a width exceeding the breadth of said circular path, and blocking the air, which is being tangentially discharged and which is in the axial spread, from returning into said circular path while guiding the air along a tangential path, thereby to optimize the pressure of air in the curtain, the rotation of the air along said path by the blower being controlled by an open ended scroll having a first portion forming a cutoff zone with the blower, a second portion encircling the blower and a third portion extending from said second portion in a direction substantially parallel to a tangent to the blower, and also extending axially beyond the blower, to form a discharge outlet for the rotary flow of air, including said axial spread, conveyed through the scroll by the blower, the blocking of the air in the axial spread being effected by an interception plate which is radially spaced from the periphery of the blower and from the scroll so as to be radially positioned in entirety therebetween, in spaced relation from both, said interception plate formin and guiding the axial spread of air in a passage between the plate and the part of the scroll extending axially beyond the blower, whereat the plate is substantially parallel to and in juxtaposition with said third portion of the scroll at a relatively small spacing for peeling off the rotary air flow and conveying the same in said curtain for tangential discharge.

18. A method as claimed in claim 17, wherein the circular path is substantially enclosed between the blower and the scroll and air input is arranged in an at least substantially perpendicular relationship to the tangential discharge of the air.

19. A method as claimed in claim 17, wherein said interception plate is formed with an inner end the projection of which is substantially tangent to the blower for promoting the peeling of the rotary air flow.

20. Apparatus comprising a blower including a plurality of parallel blades arranged to describe a cylinder, an open ended scroll including a first part encircling the blower and at least in major position spaced therefrom and a second part extending from the first part and substantially parallel to a tangent to said cylinder, said first part being generally axially coextensive with said cylinder and said second part being axially coextensive with said cylinder, but including at least a portion extending in axial direction beyond the cylinder, and a deflector plate coextensive with and in juxtaposition to said portion and including an edge portion which is in projection in at least substantially touching relationship with said cylinder, said deflector plate being offset axially relative to said cylinder, said first part of the scroll having an end portion froming an air-cutoff zone with the blower and a further portion encircling the blower, said second part extending from said further portion to form a discharge outlet for rotary flow of air conveyed through the scroll by the blower, said deflector plate being radially spaced from the periphery of the cylinder and from said portion of said second part of the scroll extending axially beyond the cylinder so as to be radially positioned in entirety between the scroll and the cylinder and in spaced relation from both to form and guide an axial spread of air in a tangential discharge path, the radial spacing of the deflector plate with respect to the scroll in combination with the arrangement of the edge portion of the deflector plate, in projection, being in substantially touching relation with the cylinder causing the deflector plate to peel off the rotary air flow and convey the same as a curtain of air for tangential discharge.

21. Apparatus as claimed in claim 20, wherein said cylinder defines an axis and said deflector plate has the configuration of a plane having generatrices parallel to the axis of the cylinder.

22. Apparatus as claimed in claim 20, wherein said end portion of first part curls in towards the cylinder.

23. Apparatus as claimed in claim 21, wherein said plane is curved.

* * * * *